United States Patent [19]

Leichtfried

[11] 4,305,604

[45] Dec. 15, 1981

[54] CONNECTING PIECE FOR A RELEASABLE ATTACHMENT

[75] Inventor: Friedrich Leichtfried, Traiskirchen, Austria

[73] Assignee: TMC Corporation, Baar, Switzerland

[21] Appl. No.: 115,527

[22] Filed: Jan. 25, 1980

[30] Foreign Application Priority Data

Feb. 5, 1979 [AT] Austria ..... 847/79

[51] Int. Cl.[3] ..... A63C 9/22

[52] U.S. Cl. ..... 280/633; 280/636

[58] Field of Search ..... 280/636, 633, 605; 403/345

[56] References Cited

U.S. PATENT DOCUMENTS

| | | | |
|---|---|---|---|
| 3,951,424 | 4/1976 | Napflin | 280/636 |
| 4,022,493 | 5/1977 | Weigl | 280/633 |
| 4,210,342 | 7/1980 | Krob | 280/636 |

*Primary Examiner*—Robert R. Song

*Attorney, Agent, or Firm*—Blanchard, Flynn, Thiel, Boutell & Tanis

[57] ABSTRACT

A connecting piece for connecting a sole support plate to a ski binding. In this disclosure, it is contemplated that a pair of such sole support plates is provided, one of which has a ski brake mounted thereon, the other of which has no ski brake associated therewith. In certain areas, ski brakes are not desirable and the skier will use safety straps for securing the ski to the leg of the skier. Thus, to enable the skier to select the mode of equipment which will meet the local conditions, a sole support plate and ski binding combination is provided which permits a selective coupling of the desired sole support plate. The connecting piece consists of a connecting member having at least one locking pin thereon received in an opening in a guide plate of the ski binding. The mutually opposing edges of the sole support plate and the guide plate engage each other to limit the amount of relative movement therebetween.

3 Claims, 7 Drawing Figures

CONNECTING PIECE FOR A RELEASABLE ATTACHMENT

FIELD OF THE INVENTION

The invention relates to a connecting piece for the releasable attachment of a sole support plate on a ski binding part, wherein the sole support plate is either free of a ski brake or has a ski brake and the ski binding part is held by means of a guide plate on a ski-fixed guide rail against lifting off and is adjustable for adaptation to differently sized ski boots along said guide rail and along the longitudinal axis of the ski and can be locked in the desired position.

BACKGROUND OF THE INVENTION

Such connecting pieces are known in various forms. The character of all such connecting devices consists in the sole support plate—independent from whether it is equipped with a ski brake or whether it merely serves as a support for the boot sole—being adjustable in the longitudinal direction of the ski together with the ski binding part and thus can be adjusted easily to differently sized ski boots. The ski-fixed guide rail which is provided for the ski binding part therefore serves at the same time as a guide for the sole support plate.

In a conventional construction of this type (Austrian Pat. No. 345 136 which corresponds to U.S. Pat. No. 4,210,342, the sole support plate has a pair of longitudinally spaced projections and openings which can engage each other to form the desired connection. The desired adjustment in the longitudinal direction of the ski can then be carried out in the unlocked condition of the ski binding. To exchange such a sole support plate, the anchorage of a connecting web must be released from the ski binding part, which operation by itself is simple. Also the suspension of a different sole support plate does not create any special problems even for the average skier. However, for a satisfactory function to occur, great precision is needed, particularly for the support and guiding of the connecting web on the ski binding part.

Therefore, the goal of the invention is to provide in a connecting piece of the above-mentioned type an improvement so that the connection is achieved by simpler means than was possible in the aforedescribed conventional construction. Furthermore, the possibility is to be created that existing structural parts are included as active means in attaining the set purpose.

The set goal is inventively solved by the sole support plate carrying a connecting member which extends in direction toward the guide plate of the ski binding, which connecting member has at least one, preferably two locking pins which are positioned perpendicularly relative to the upper surface of the ski, and by the guide plate of the ski binding having at least one, preferably two locking openings, into which in the locking position the individual locking pins of the connecting member are guided from below, wherein the sole support plate rests with its rearwardly facing edge on the front edge of the guide plate.

The inventive measure incorporates both the guide plate of the ski binding part and also the connecting member of the sole support plate into the connecting function of these two structural parts. The utilization of simple, engaging locking means is conceivably simple both as it concerns the manufacture and also the handling.

A preferable embodiment of the invention consists in the locking pins being constructed so as to project above the locking openings of the guide plate in the vertical direction, wherein said projecting portion of the individual locking pins forms during a release operation a stop limiting the lateral movement of the ski binding. The simultaneous use of the two locking pins as stops for the lateral limitation of the release path of the ski binding saves utilization of additional structural parts.

A further thought of the invention consists in the connecting member having directly in front of the region of the two locking pins—viewed transversely with respect to the longitudinal direction of the ski—a substantially U-shaped bent portion. Through this structure an inadvertent uncoupling of the locking pins from the locking opening is avoided.

Further utilizing the coupling function of guide plate and sole support plate, a further thought of the invention is seen in each of the two opposed edges on the sole support plate and on the guide plate, having a sloped section or rounded-off section—viewed in a top view—adjacent their two lateral sides, and the locking pins which engage the locking openings of the guide plate being constructed cylindrically.

A modification of the preceding thought of the invention consists in the locking pins which engage the cylindrical locking openings of the guide plate being constructed conically, wherein the conicity is aligned tapering convergingly starting out from the upper surface of the connecting member.

A still further modification of the preceding two solutions consists inventively in the connecting member having one single locking pin which is arranged centrally on the longitudinal axis of the ski, which engages a correspondingly shaped locking opening, wherein the upper free end of the locking pin terminates flush with the upper surface of the guide plate. This construction is intended for the case when the lateral limitation of the release path of the ski binding is already provided in the ski binding part itself or when, due to a lack of space, a projecting of the locking pins above the upper surface of the guide plate would be undesired.

BRIEF DESCRIPTION OF THE DRAWINGS

Further details, characteristics and advantages of the invention will now be explained in more detail with reference to the drawings, which illustrate two exemplary embodiments.

In the drawings.

DETAILED DESCRIPTION

The following description describes structural parts, which do not concern the actual subject matter of the invention, only inasfar as this is necessary for the understanding of the subject matter of the invention.

Figure 2:
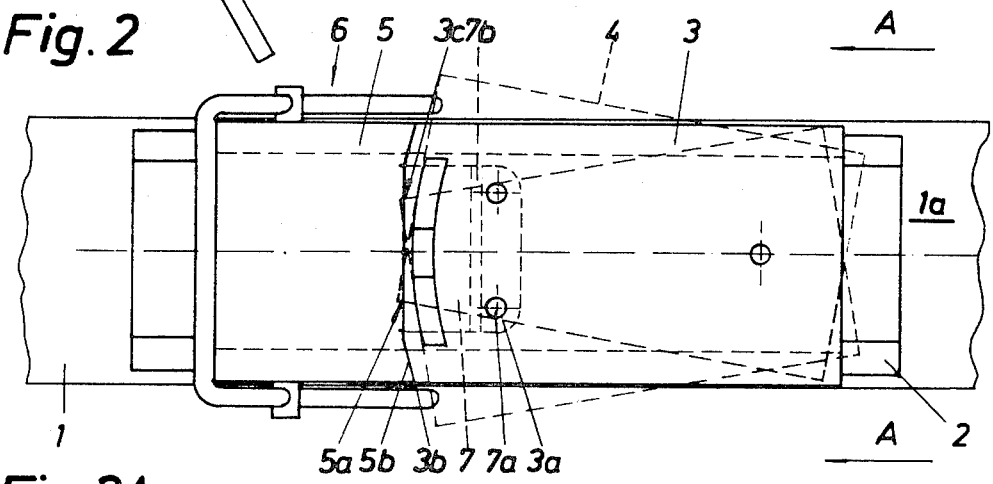
FIG. 2 is a top view of FIG. 1 wherein, however, the ski brake is connected to the safety binding.

As can be recognized from the drawings, a ski 1 is provided on the upper surface 1*a* thereof with a guide rail 2 secured thereto, for example by screws (the screws are not illustrated separately). The guide rail 2 serves to guide a guide plate 3 of a ski binding 4 guidingly coupled thereto. For a better understanding, FIG. 2 illustrates the ski binding 4 only schematically, so that the coupling of a sole support plate 5 which carries a ski brake 6 with the guide plate 3 can clearly be seen. Dashed lines indicate the two positions of the ski binding 4 swung through its greatest possible lateral swivelled position during a so-called "diagonal" release movement about both a vertical axis and a horizontal axis of the ski binding 4.

As can further be recognized from FIG. 2, the sole support plate 5 is connected by means of a connecting member 7 to the ski binding 4. For this purpose, those ends of the connecting member 7, which face the ski binding 4, carry two laterally spaced, cylindrical locking pins 7*a*, the longitudinal axes of which extend perpendicular to the upper surface 1*a* of the ski 1.

The guide plate 3 of the ski binding 4 has two locking pin receiving openings 3*a* therein. The locking pins 7*a* on the connecting member 7 are guided into these openings from below and are thus hooked into the locking openings 3*a*. The arrangement of the locking openings 3*a* has been chosen so that the rearwardly facing edge 5*a* of the sole support plate 5 rests against the frontwardly facing edge 3*c* of the guide plate 3. To avoid practically any relative movement between the sole support plate 5 and the guide plate 3, the two opposing edges of the sole support plate 5 and the guide plate 3—viewed in a top view—are each provided with opposed and angled surface areas 5*b* and 3*b*, respectively, laterally spaced from the longitudinal centerline of the ski and at an acute angle thereto.

Figure 3A:
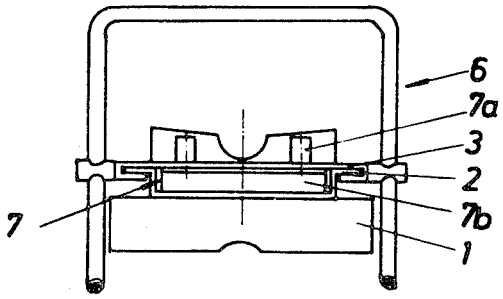
FIG. 3A is a view in the direction A of FIG. 2 with the housing of the safety ski binding being omitted.
Figure 3B:
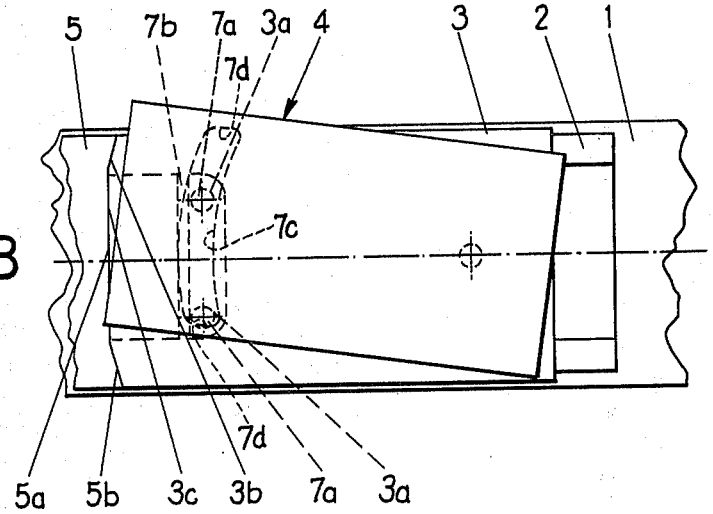
FIG. 3B is a top view of the ski binding in the broken line position of FIG. 2, particularly one of the locking pins cooperating with structure on the ski binding to limit the amount of lateral pivoting thereof.

The locking pins 7*a* extend through the locking openings 3*a* in the guide plate 3 and project above same. Each upwardly projecting part of the locking pins 7*a* projects into an arcuate slot 7*c* (FIG. 3B) on the ski binding to define a stop 7*d* at the lateral ends thereof for the ski binding 4 during a lateral release above the aforesaid vertical and horizontal axes ("diagonal" release).

In order to prevent a slipping of the locking pins 7*a* out of the locking openings 3*a* due to vibrations, the connecting member 7 is—viewed transversely with respect to the longitudinal axis of the ski—provided with a U-shaped segment 7*b*. The U-shaped portion 7*b* is appropriately supported by the web part of the U resting on the upper surface 1*a* of the ski 1. The U-shaped segment 7*b* is located directly in front of the locking pins 7*a* and extends across the full width of the connecting member 7. The height of the U-shaped portion 7*b* is chosen such that in the engaged condition of the locking pins 7*a* there exists hardly any play between the connecting member 7, the guide rail 2 and the guide plate 3.

It will be recognized without any further discussions, that in order to install or remove the sole support plate 5 special measures are not required. All that is required is to release an actually known and for this reason not illustrated locking mechanism on the ski binding 4 and to slide the ski binding 4 with the attached sole support plate 5 off from the guide rail 2. See U.S. Pat. No. 4,022,493 for an example of a structure for facilitating a removal of the ski binding from a guide rail fixed to a ski. Subsequently the locking pins 7*a* will be disengageable from the guide plate 3 and a further sole support plate, which does not carry a ski brake, can be connected to the guide plate 3. The ski binding 4 with the further sole support plate, which is free of the ski brake, is subsequently just as easily movable onto the guide rail 2 and fixed thereon, as was the case during the removal of said structural parts. The design facilitates an installation and removal which can be carried out easily even by inexperienced skiers following the usual instructions. A further advantage consists in no tool being needed to release the support plate 5 from the ski binding 4 and for the subsequent assembly of said structural parts. Similar is the mode of operation during an exchange of a sole support plate 5 which carries a ski brake 6.

Figure 1:
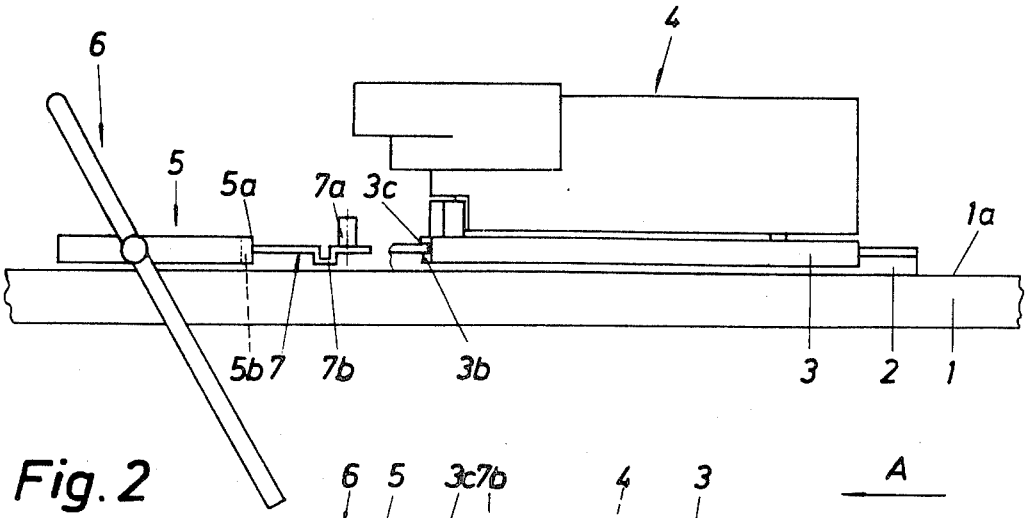
FIG. 1 illustrates a side view of a ski brake having the inventive connecting element and a safety binding with an associated guide rail.
Figure 4:
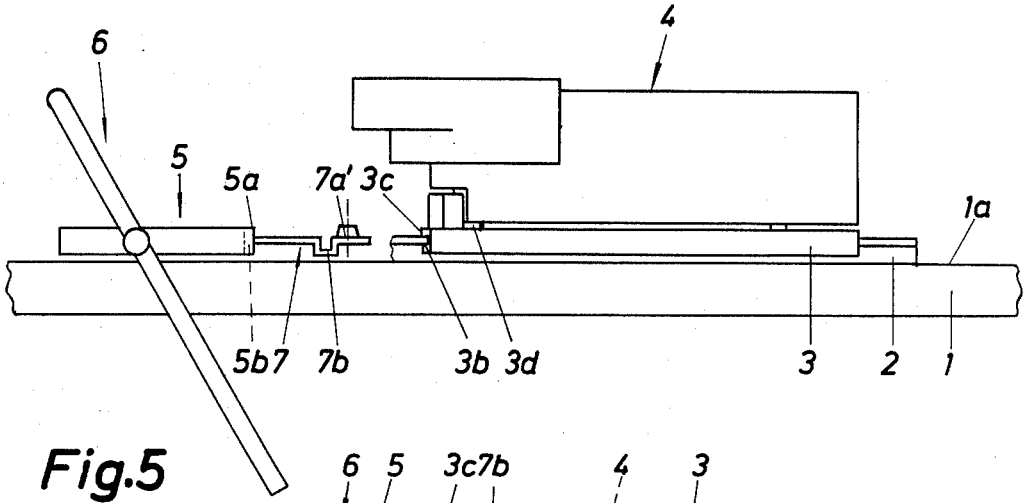
FIGS. 4 and 5 are a side and top view, respectively, of a further exemplary embodiment in locked condition.
Figure 5:
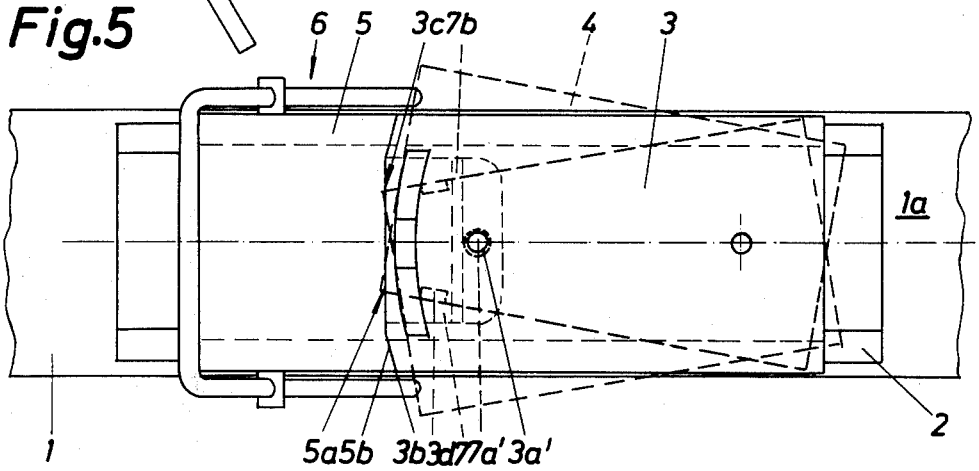

The construction and the arrangement of the structural parts is in the second exemplary embodiment according to FIGS. 4 and 5 substantially identical to that of FIGS. 1 and 2. Therefore, the already used structural parts will no longer be described hereinbelow. This exemplary embodiment utilizes a conically shaped locking pin 7*a*′, the cone of which is aligned convergingly tapered upwardly starting out from the upper surface of the connecting member 7. The locking pin 7*a*′ is arranged in the region of the central longitudinal axis of the ski in direction toward the tail end of the ski from the U-shaped portion 7*b* on the connecting member 7. The conical pin 7*a*′ is received in a correspondingly tapered locking opening 3*a*′ in the guide plate 3 and is held therein play-free due to the conicity. The length of the locking pin 7*a*′ is chosen so that it does not project above the guide plate 3 in the engaged condition, that is, the upper end terminates flush with same. Thus the stop, formed by the locking pins, for lateral swivelling movements of the ski binding 4 is not present in this embodiment.

Figure 6:
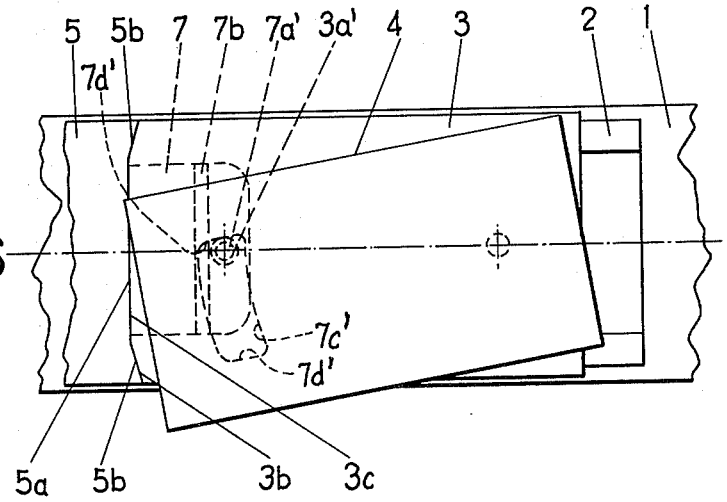
FIG. 6 is a top view of the ski binding in one of the broken line positions of FIG. 5, particularly the locking pin cooperating with structure on the ski binding to limit the amount of lateral pivoting thereof.

The guide plate 3 carries therefore on its upper surface, in the region of the end which is adjacent the front edge 3*c*, two rectangular stops 3*d*. These stops 3*d* are arranged such that the ski binding 4 in its swung-out position rests snugly on one longitudinal side of the rectangular stops 3*d*. One can recognize this in particular from FIG. 5, in which the ski binding 4 is indicated by dashed lines in the swivelled positions toward both lateral sides. If desired, the locking pin 7*a*′ can project above the guide plate 3 to cooperate with structure on the ski binding, such as the lateral edges 7*d*′ of an arcuate slot 7*c*′ as shown in FIG. 6.

A connecting and releasing of the sole support plate 5 to or from the ski binding 4 takes place also in this exemplary embodiment with the help of the connecting member which is the subject matter of the invention in an equally simple manner as this is the case in the first exemplary embodiment. A tool is also not needed for this.

The invention is not limited to the illustrated exemplary embodiments. Further variations can be made without departing from the scope of the invention. A modification can consist in the sole support plate and the guide plate not having at the ends which face one another sloped sections but rounded-off sections, preferably in the form of an arc.

The listed exemplary emodiments illustrated the ski bindings as heel holders. It is easily conceivable to use the connecting device for mounting a sole support and/or a slide plate on a front jaw. One of the exchangeable plates can then have a suitable ski brake associated with it.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a connecting piece for the releasable attachment of a sole support plate on a ski binding part, said sole support plate being either free of a ski brake or having a ski brake thereon and said ski binding part being held against lifting off by means of a guide plate movably supported on a ski-fixed guide rail in the longitudinal direction of said ski to facilitate an adjustment to differently sized ski boots and being lockable in a desired position, the improvement comprising wherein said sole support plate has a connecting member which extends in a direction toward said guide plate of said ski binding, which connecting member has at least one locking pin positioned perpendicularly upright relative to an upper surface of said ski, wherein said guide plate of said ski binding has at least one pin receiving opening therein, said locking pin being selectively and slidably received in said pin receiving opening from below said guide plate, wherein said sole support plate rests with its rearwardly facing edge on the frontwardly facing edge of said guide plate, wherein said locking pin in said locking opening in said guide plate extends in a vertical direction, and wherein said upwardly projecting portion of said locking pin forms during a release operation a stop for the lateral movement of said ski binding part.

2. In a connecting piece for the releasable attachment of a sole support plate on a ski binding part, said sole support plate being either free of a ski brake or having a ski brake thereon and said ski binding part being held against lifting off by means of a guide plate movably supported on a ski-fixed guide rail in the longitudinal direction of said ski to facilitate an adjustment to differently sized ski boots and being lockable in a desired position, the improvement comprising wherein said sole support plate has a connecting member which extends in a direction toward said guide plate of said ski binding, which connecting member has at least one locking pin positioned perpendicularly upright relative to an upper surface of said ski, wherein said guide plate of said ski binding has at least one pin receiving opening therein, said locking pin being selectively and slidably received in said pin receiving opening from below said guide plate, wherein said sole support plate rests with its rearwardly facing edge on the frontwardly facing edge of said guide plate, and wherein said locking pin is mounted on a connecting member which is secured to said sole support plate and has directly in front of the area of said locking pin, viewed transversely with respect to the longitudinal axis of the ski, a substantially U-shaped bent portion.

3. In a connecting piece for the releasable attachment of a sole support plate on a ski binding part, said sole support plate being either free of a ski brake or having a ski brake thereon and said ski binding part being held against lifting off by means of a guide plate movably supported on a ski-fixed guide rail in the longitudinal direction of said ski to facilitate an adjustment to differently sized ski boots and being lockable in a desired position, the improvement comprising wherein said sole support plate has a connecting member which extends in a direction toward said guide plate of said ski binding, which connecting member has at least one locking pin positioned perpendicularly upright relative to an upper surface of said ski, wherein said guide plate of said ski binding has at least one pin receiving opening therein, said locking pin being selectively and slidably received in said pin receiving opening from below said guide plate, wherein said sole support plate rests with its rearwardly facing edge on the frontwardly facing edge of said guide plate, and wherein the two opposed edges of said sole support plate and of said guide plate have at each of their two lateral sides, viewed in a top view, an angled section, and wherein two laterally spaced said locking pins are provided which each are received in a respective one of two said locking openings provided in said guide plate and have a cylindrical cross section.

* * * * *